US011228101B2

(12) United States Patent
Hashiguchi

(10) Patent No.: US 11,228,101 B2
(45) **Date of Patent: *Jan. 18, 2022**

(54) ANTENNA

(71) Applicant: JAPAN AVIATION ELECTRONICS INDUSTRY, LIMITED, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/848,898

(22) Filed: Apr. 15, 2020

(65) Prior Publication Data

US 2020/0411975 A1 Dec. 31, 2020

(51) Int. Cl.
*H01Q 1/38* (2006.01)

(52) U.S. Cl.
CPC ..... *H01Q 1/38* (2013.01)

(58) Field of Classification Search
None
See application file for complete search history.

(56) References Cited

U.S. PATENT DOCUMENTS

| | | | | |
|---|---|---|---|---|
| 7,113,143 | B2 | 9/2006 | Minemura | |
| 9,203,154 | B2 | 12/2015 | Korva | |
| 9,502,761 | B2 | 11/2016 | Itoh et al. | |
| 10,211,541 | B2 | 2/2019 | Sano et al. | |
| 2002/0021249 | A1* | 2/2002 | Kuck | H01Q 9/14 343/700 MS |
| 2006/0001575 | A1 | 1/2006 | Jo et al. | |
| 2007/0176827 | A1 | 8/2007 | Itoh et al. | |
| 2009/0027275 | A1 | 1/2009 | Su et al. | |
| 2010/0265146 | A1* | 10/2010 | Montgomery | H01Q 1/38 343/722 |
| 2011/0109510 | A1 | 5/2011 | Onaka et al. | |

(Continued)

FOREIGN PATENT DOCUMENTS

| | | | |
|---|---|---|---|
| JP | 2005203854 | A | 7/2005 |
| JP | 2016225956 | A | 12/2016 |

(Continued)

OTHER PUBLICATIONS

Office Action (Non-Final Rejection) dated Mar. 28, 2021 issued in related U.S. Appl. No. 16/848,911.

(Continued)

*Primary Examiner* — Crystal L Hammond
(74) *Attorney, Agent, or Firm* — Holtz, Holtz & Volek PC

(57) ABSTRACT

An antenna has an antenna main portion formed on a substrate and a facing portion separate and distinct from the substrate. The antenna main portion has a ring shape with a split and has a first end portion and a second end portion which form the split. The facing portion has a holding member, a first facing portion made of conductive material and a second facing portion made of the conductive material. The first facing portion and the second facing portion are held by the holding member so as to be located apart from each other. The first facing portion has a first principal portion and a first connected portion connected to the first end portion. The second facing portion has a second principal portion facing the first principal portion and a second connected portion connected to the second end portion.

5 Claims, 10 Drawing Sheets

(56) References Cited

U.S. PATENT DOCUMENTS

| | | | | |
|---|---|---|---|---|
| 2011/0128187 | A1 | 6/2011 | Ju et al. | |
| 2012/0007782 | A1 | 1/2012 | Nishio et al. | |
| 2014/0203987 | A1 | 7/2014 | Itoh et al. | |
| 2015/0288071 | A1 | 10/2015 | Toyao | |
| 2016/0294048 | A1 | 10/2016 | Xu et al. | |
| 2017/0117612 | A1 | 4/2017 | Toyao et al. | |
| 2018/0351231 | A1 | 12/2018 | Sarkis et al. | |
| 2019/0267968 | A1* | 8/2019 | Hamatani ..... | H03H 9/02559 |
| 2020/0252042 | A1 | 8/2020 | Mori et al. | |
| 2020/0335849 | A1 | 10/2020 | Hashiguchi | |
| 2020/0412024 | A1 | 12/2020 | Hashiguchi | |

FOREIGN PATENT DOCUMENTS

| | | | |
|---|---|---|---|
| JP | 2018174585 | A | 11/2018 |
| JP | 2018537037 | A | 12/2018 |

OTHER PUBLICATIONS

Related U.S. Appl. No. 16/848,911 First Named Inventor: Osamu Hashiguchi; Title: "Antenna and Partly Finished Product of Facing Portion Used in the Same"; Filed: Apr. 15, 2020.

Office Action (Final Rejection) dated Jun. 29, 2021, issued in related U.S. Appl. No. 16/848,911.

Extended European Search Report (EESR) dated Sep. 16, 2020 issued in European Application No. 20159316.7.

Related U.S. Appl. No. 16/784,500, First Named Inventor: Osamu Hashiguchi; Title: "Antenna"; Filed: Feb. 7, 2020.

Notice of Allowance dated Aug. 25, 2021 issued in related U.S. Appl. No. 16/848,911.

Office Action (Non-Final Rejection) dated Aug. 19, 2021 issued in related U.S. Appl. No. 16/784,500.

* cited by examiner

ANTENNA

CROSS REFERENCE TO RELATED APPLICATIONS

This application is based on and claims priority under 35 U.S.C. § 119 to Japanese Patent Application No. JP2019-119560 filed Jun. 27, 2019, the contents of which are incorporated herein in their entirety by reference.

BACKGROUND OF THE INVENTION

This invention relates to an antenna, particularly, to an antenna having a main portion formed on a substrate and a facing portion separate and distinct from the substrate.

JP2016-225956A (Patent Document 1) discloses an antenna having a split ring resonator structure. As shown in FIG. 19, an antenna 90 of Patent Document 1 has a dielectric layer 910, a conductor layer 920 formed on one of a pair of main surfaces of the dielectric layer 910, and a feeding line 930 formed on the other of the main surfaces of the dielectric layer 910. The conductor layer 920 is formed in a C-shape. Moreover, both end portions of the conductor layer 920 are apart from each other and face each other to form a facing portion 940 which operates as a capacitor. The conductor layer 920 and the feeding line 930 are connected to each other by use of a via 950 which passes through the dielectric layer 910. In detail, the via 950 connects an end portion of the feeding line 930 to the vicinity of one of the end portions of the conductor layer 920.

SUMMARY OF THE INVENTION

The antenna of Patent Document 1 is produced using a printed substrate.

When the antenna produced using the printed substrate does not obtain desired characteristics due to manufacture variations or the like, it is necessary to further add a matching circuit, such as an inductor, a capacitor and so on, to the already-produced antenna or remake the substrate as such. Accordingly, the antenna of Patent Document 1 has a problem that it is difficult to adjust variations of antenna characteristics.

It is therefore an object of the present invention to provide an antenna which is provided with a discrete part separate and distinct from a substrate as a facing portion so as to adjust variations of antenna characteristics easily.

One aspect of the present invention provides an antenna having an antenna main portion formed on a substrate and a facing portion separate and distinct from the substrate. The antenna main portion has a ring shape with a split and has a first end portion and a second end portion which are located apart from each other in a lateral direction parallel with the substrate to form the split. The facing portion has a holding member, a first facing portion made of conductive material and a second facing portion made of the conductive material. The first facing portion and the second facing portion are held by the holding member so as to be located apart from each other. The first facing portion has a first principal portion and a first connected portion which extends from the first principal portion and which is connected to the first end portion. The second facing portion has a second principal portion facing the first principal portion and a second connected portion which extends from the second principal portion and which is connected to the second end portion.

The antenna according to the aspect of the present invention has the antenna main portion formed on the substrate and the facing portion separate and distinct from the substrate. Since the facing portion is separate and distinct from the substrate, antenna characteristics can be easily adjusted by replacement of the facing portion.

Moreover, in the facing portion of the antenna of the present invention, the first facing portion and the second facing portion are held by the holding member so as to be located apart from each other. Since a relative position between the first facing portion and the second facing portion is fixed by the holding member, variations of characteristics caused by positional displacement of the first facing portion and the second facing portion are prevented when the facing portion is attached to the substrate.

An appreciation of the objectives of the present invention and a more complete understanding of its structure may be had by studying the following description of the preferred embodiment and by referring to the accompanying drawings.

Figure 1:
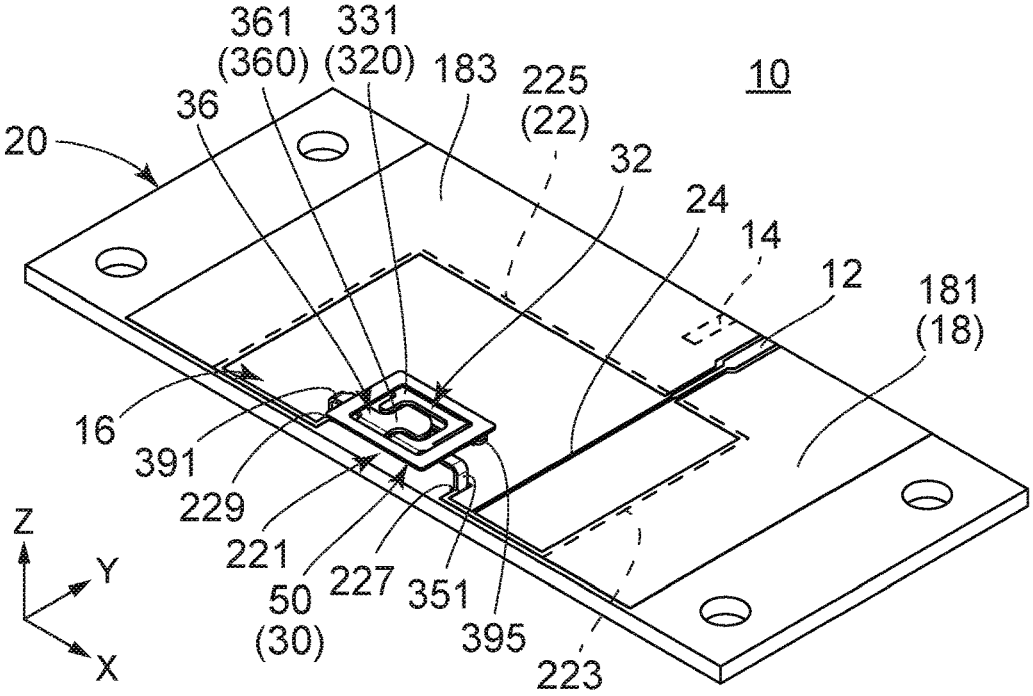
FIG. 1 is a perspective view showing an antenna according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
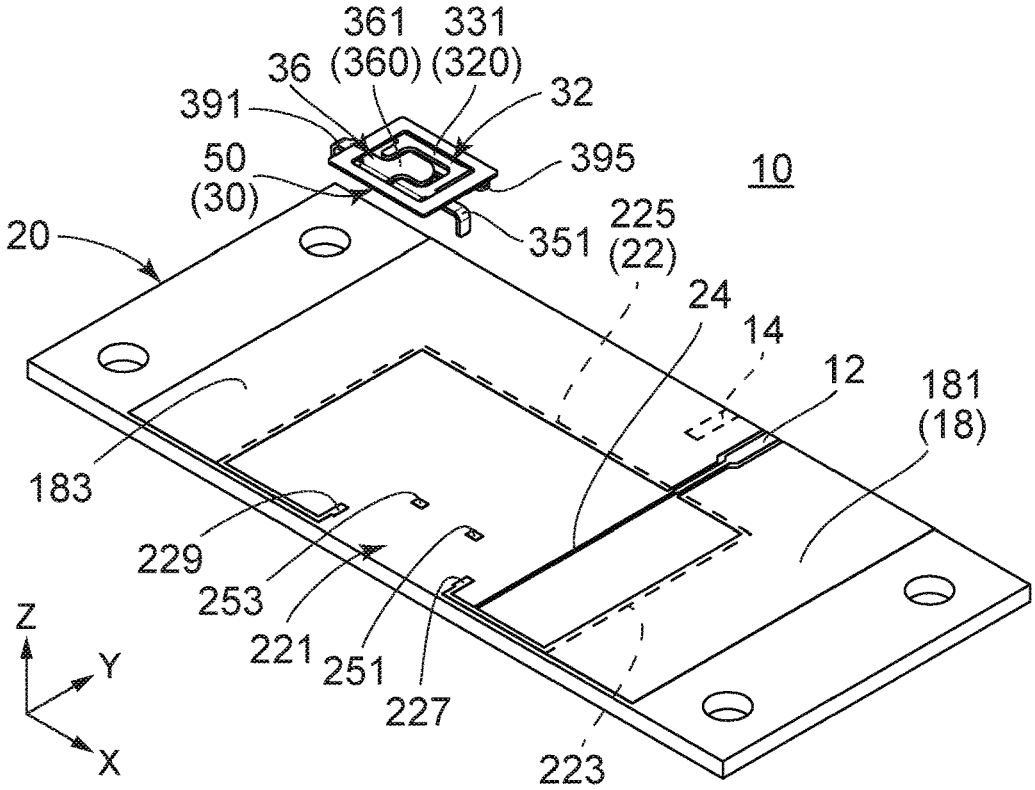
FIG. 2 is an exploded, perspective view showing the antenna of FIG. 1.

Referring to FIGS. 1 and 2, an antenna 10 according to a first embodiment of the present invention is provided with a first terminal 12, a second terminal 14, an LC resonator 16 connected to the first terminal 12 and a ground plane 18 connected to the LC resonator 16 and the second terminal 14. In the present embodiment, the LC resonator 16 has an antenna main portion 22 formed on a substrate 20 and a facing portion 30 mounted on the substrate 20. In other words, the antenna 10 is provided with the antenna main portion 22 united with the substrate 20 and the facing portion 30 as a discrete part separate and distinct from the substrate 20 in the present embodiment. In the present embodiment, the antenna main portion 22 works as an inductor (L), and the facing portion 30 works as a capacitor (C).

As understood from FIGS. 1 and 2, the antenna main portion 22 has a ring shape with a split 221 when viewed along a perpendicular direction perpendicular to the substrate 20. In other words, the antenna main portion 22 has an angular C-shape in the present embodiment when viewed along the perpendicular direction. In the present embodiment, the perpendicular direction is a Z-direction identical with an up-down direction. A positive Z-direction is directed upward while a negative Z-direction is directed to downward.

As shown in FIGS. 1 and 2, the antenna main portion 22 has a first portion 223 and a second portion 225 which are formed on an upper surface of the substrate 20. The antenna main portion 22 further has one or more additional portions (not shown) formed in one or more conductive layers (not shown) of the substrate 20. Here, the conductive layers include inner conductive layers (not shown) formed in the substrate 20 and a lower conductive layer (not shown) formed on a lower surface of the substrate 20. The additional portions are formed to overlap with both of the first portion 223 and the second portion 225 viewed along the up-down direction. Moreover, the additional portions are electrically connected to the first portion 223 in the up-down direction, and they are also electrically connected to the second portion 225 in the up-down direction. With this structure, the first portion 223 of the antenna main portion 22 and the second portion 225 of the antenna main portion 22 are electrically connected to each other via the additional portions.

As shown in FIGS. 1 and 2, the antenna main portion 22 has a first end portion 227 and a second end portion 229 which are located apart from each other in a lateral direction parallel with the substrate 20. The first end portion 227 and the second end portion 229 form the split 221 of the antenna main portion 22. The facing portion 30 is connected to the first end portion 227 and the second end portion 229. In the present embodiment, the lateral direction is an X-direction.

As understood from FIGS. 1 and 2, the second terminal 14 and the ground plane 18 are integrally formed. In the present embodiment, the ground plane 18 has a first portion 181 and a second portion 183. The second terminal 14 is integrally formed with the second portion 183.

As shown in FIGS. 1 and 2, the first portion 181 of the ground plane 18 is integrally formed with the first portion 223 of the antenna main portion 22. Moreover, the second portion 183 of the ground plane 18 is integrally formed with the second portion 225 of the antenna main portion 22. The first portion 181 of the ground plane 18 extends outward of the first portion 223 of the antenna main portion 22 in the lateral direction and extends rearward of the first portion 223 of the antenna main portion 22 in a front-rear direction. Moreover, the second portion 183 of the ground plane 18 extends outward of the second portion 225 of the antenna main portion 22 in the lateral direction and extends rearward of the second portion 225 of the antenna main portion 22 in the front-rear direction. The first portion 181 of the ground plane 18 and the second portion 183 of the ground plane 18 are electrically connected to each other via a subsidiary ground plane (not shown) formed in the inner conductive layer (not shown) of the substrate 20 or formed on the lower surface of the substrate 20. In the present embodiment, the front-rear direction is a Y-direction. A negative Y-direction is directed forward while a positive Y-direction is directed rearward.

As shown in FIGS. 1 and 2, the first terminal 12 is connected to a feeding line 24. The feeding line 24 passes between the first portion 181 of the ground plane 18 and the second portion 183 of the ground plane 18 and between the first portion 223 of the antenna main portion 22 and the second portion 225 of the antenna main portion 22 to extend forward from the first terminal 12. In addition, the feeding line 24 is connected to the first portion 223 of the antenna main portion 22 in the vicinity of the first end portion 227 of the antenna main portion 22. Although the first terminal 12 and the feeding line 24 are formed on the upper surface of the substrate 20 in the present embodiment, the present invention is not limited thereto. The first terminal 12 and the feeding line 24 may be formed on the lower surface (not shown) of the substrate 20. In that case, the first portion 223 of the antenna main portion 22 and the second portion 225 of the antenna main portion 22 may be integrally formed. Similarly, the first portion 181 of the ground plane 18 and the second portion 183 of the ground plane 18 may be integrally formed.

Figure 3:
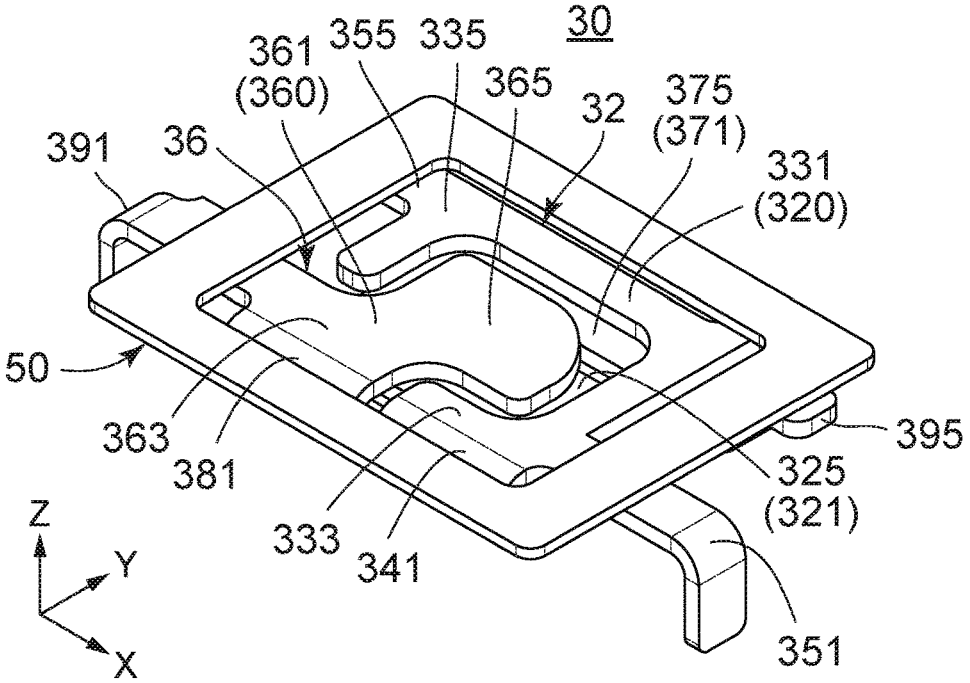
FIG. 3 is a perspective view showing a facing portion included in the antenna of FIG. 1.

Referring to FIG. 3, the facing portion 30 has a first facing portion 32, a second facing portion 36 and a holding member 50. The first facing portion 32 and the second facing portion 36 are made of the same conductive material as each other. The holding member 50 is an insulating tape having an adhesive layer on one side of the insulating tape. However, the present invention is not limited thereto. The holding member 50 may be a thin plate made of insulation resin. In that case, the holding member 50 may be bonded to the first facing portion 32 and the second facing portion 36 using a bonding member, such as an adhesive or a double-sided adhesive tape.

Figure 9:
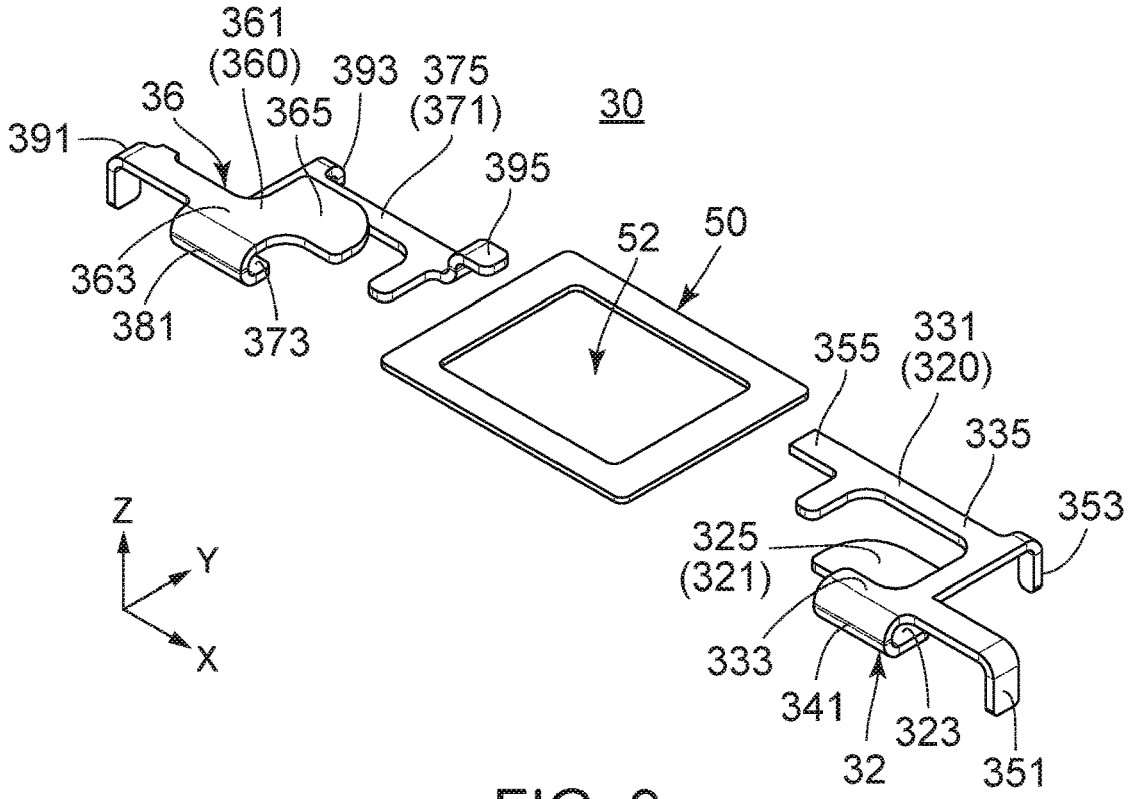
FIG. 9 is an exploded, perspective view showing the facing portion of FIG. 3.

As understood from FIG. 9, the first facing portion 32 and the second facing portion 36 are separate and distinct from each other. The first facing portion 32 and the second facing portion 36 are held by the holding member 50 in a state that the first facing portion 32 and the second facing portion 36 are apart from each other. In detail, the holding member 50 is bonded to the first facing portion 32 and the second facing portion 36 to hold the first facing portion 32 and the second facing portion 36. Thus, a relative position between the first facing portion 32 and the second facing portion 36 is fixed.

Figure 4:
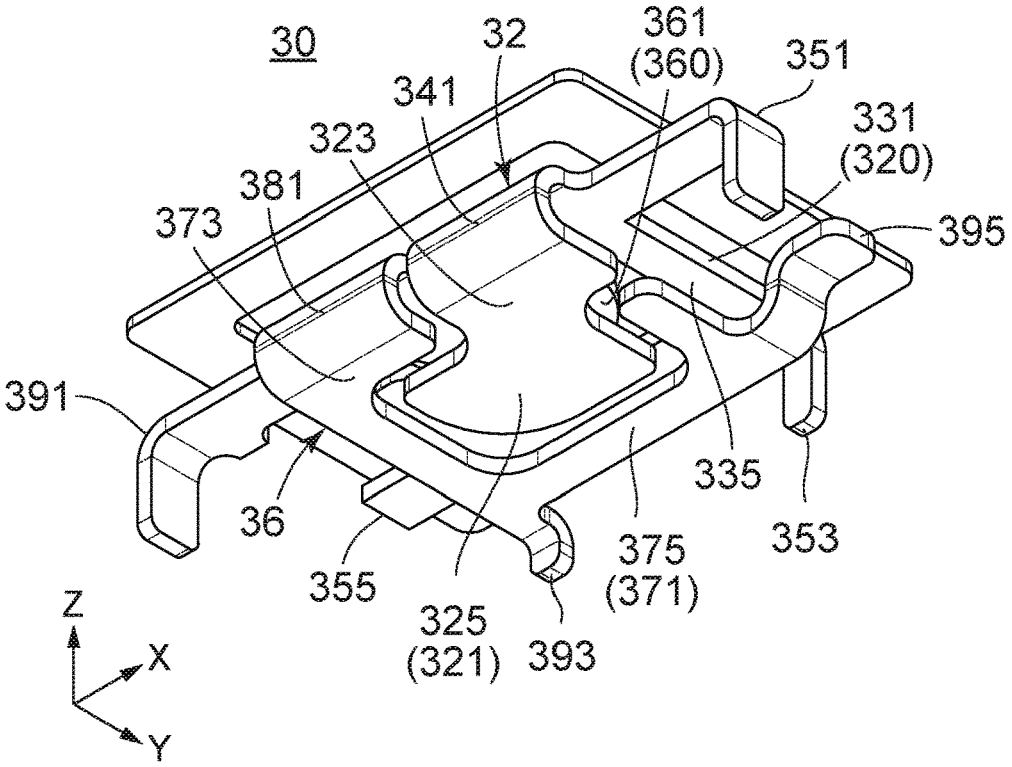
FIG. 4 is another perspective view showing the facing portion of FIG. 3.

As shown in FIGS. 3, 4 and 9, the first facing portion 32 has a first principal portion 320, a first connected portion 351 extending from the first principal portion 320, a first fixed portion 353 extending from the first principal portion 320 and a first held portion 355 extending from the first principal portion 320.

As shown in FIGS. 3 to 8, the first principal portion 320 has a first middle plate portion 321, a first periphery plate portion 331 and a first bent portion 341 connecting the first middle plate portion 321 and the first periphery plate portion 331 to each other. The first middle plate portion 321 has a base portion 323 and a main body portion 325 extending diagonally rearward from the base portion 323. The first periphery plate portion 331 has a base portion 333 and an extension portion 335 extending from the base portion 333. The extension portion 335 extends rearward from the base portion 333 and then extends in the lateral direction, and further extends forward. The first bent portion 341 connects the base portion 323 of the first middle plate portion 321 and the base portion 333 of the first periphery plate portion 331 to each other in the up-down direction.

Figure 8:
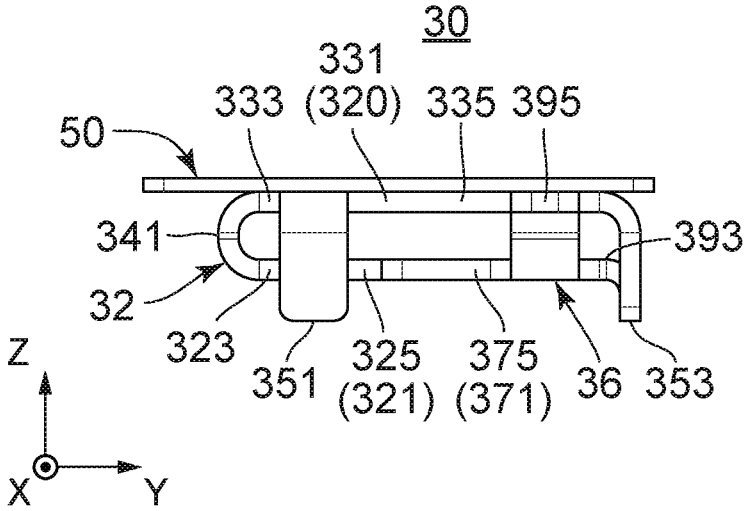
FIG. 8 is a right side view showing the facing portion of FIG. 3.

As understood from FIGS. 3, 4 and 8, the first middle plate portion 321 and the first periphery plate portion 331 are arranged so as to be perpendicular to the up-down direction, and they are located apart from each other in the up-down direction. In the present embodiment, the first middle plate portion 321 is located downward of the first periphery plate portion 331 in the up-down direction.

As shown in FIGS. 3 to 9, the first connected portion 351 extends outward in the lateral direction from the base portion 333 of the first periphery plate portion 331 and then extends downward.

As shown in FIG. 4 and FIGS. 6 to 9, the first fixed portion 353 extends rearward from a rear edge of the first periphery plate portion 331 and then extends downward. The first fixed portion 353 is used as a mounted portion to be mounted on the substrate 20.

As shown in FIGS. 3 to 6 and FIG. 9, the first held portion 355 is located near the rear edge of the first periphery plate portion 331 and extends from an edge of a side portion of the first periphery plate portion 331 in the lateral direction. The first held portion 355 extends in a direction opposite to an extending direction of the first fixed portion 353 in the lateral direction.

As shown in FIG. 3 and FIGS. 4 to 9, the second facing portion 36 has a second principal portion 360, a second connected portion 391 extending from the second principal portion 360, a second fixed portion 393 extending from the second principal portion 360 and a second held portion 395 extending from the second principal portion 360.

As understood from FIGS. 3 to 6, the second principal portion 360 is the same as the first principal portion 320 turned upside down. In detail, the second principal portion 360 has a second middle plate portion 361, a second periphery plate portion 371 and a second bent portion 381 connecting the second middle plate portion 361 and the second periphery plate portion 371 to each other. The second middle plate portion 361 has a base portion 363 and a main body portion 365 extending diagonally rearward from the base portion 363. The second periphery plate portion 371 has a base portion 373 and an extension portion 375 extending from the base portion 373. The extension portion 375 extends rearward from the base portion 373 and then extends in the lateral direction, and further extends forward. The second bent portion 381 connects the base portion 363 of the second middle plate portion 361 and the base portion 373 of the second periphery plate portion 371 to each other in the up-down direction.

As understood from FIGS. 3, 4 and 8, the second middle plate portion 361 and the second periphery plate portion 371 are arranged so as to be perpendicular to the up-down direction, and they are located apart from each other in the up-down direction. In the present embodiment, the second middle plate portion 361 is located upward of the second periphery plate portion 371 in the up-down direction.

As shown in FIGS. 3 to 7 and FIG. 9, the second connected portion 391 extends outward in the lateral direction from the base portion 363 of the second middle plate portion 361 and then extends downward.

As shown in FIG. 4 and FIGS. 6 to 9, the second fixed portion 393 extends rearward from a rear edge of the second periphery plate portion 371 and then extends downward. The second fixed portion 393 is used as a mounted portion to be mounted on the substrate 20.

As shown in FIGS. 3 to 9, the second held portion 395 is located near the rear edge of the second periphery plate portion 371. The second held portion 395 extends from an edge of a side portion of the second periphery plate portion 371 in the lateral direction and then extends upward, and further extends in the lateral direction. The second held portion 395 extends in a direction opposite to an extending direction of the second fixed portion 393 in the lateral direction. As understood from FIG. 4, in the up-down direction, a tip portion of the second held portion 395 is located at the same position as the first held portion 355.

As understood from FIGS. 5 to 8, the first middle plate portion 321 and the second periphery plate portion 371 are coplanar with each other. Moreover, the first periphery plate portion 331 and the second middle plate portion 361 are coplanar with each other. As understood from FIGS. 5 and 6, when viewed along the up-down direction, the main body portion 325 of the first middle plate portion 321 and the main body portion 365 of the second middle plate portion 361 are roughly identical with each other. In addition, when viewed along the up-down direction, the extension portion 335 of the first periphery plate portion 331 and the extension portion 375 of the second periphery plate portion 371 are roughly identical with each other.

Figure 5:
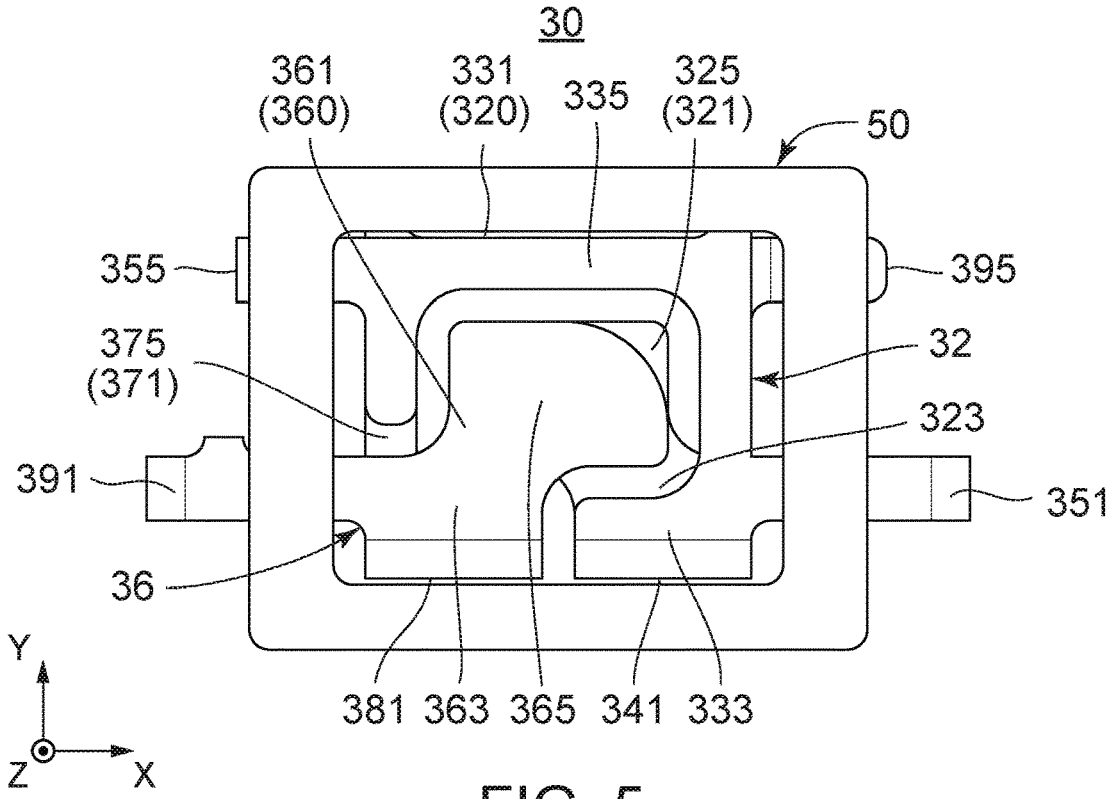
FIG. 5 is a plan view showing the facing portion of FIG. 3.
Figure 6:
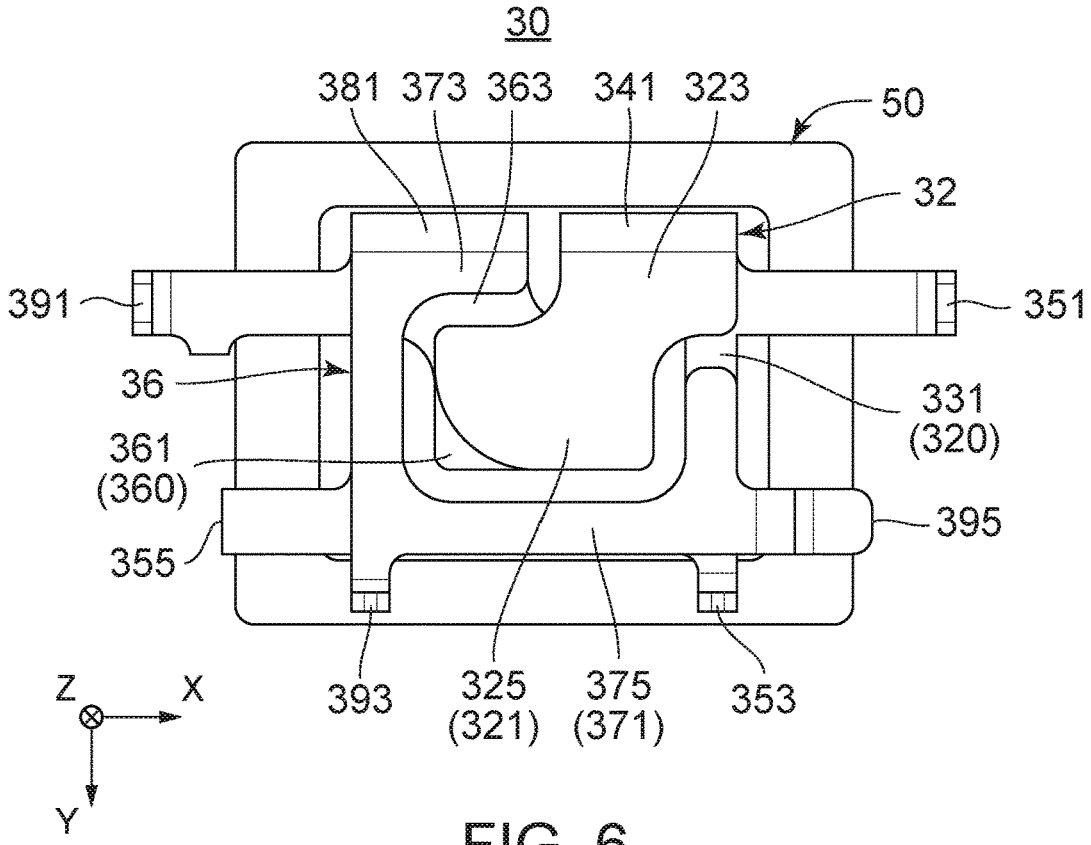
FIG. 6 is a bottom view showing the facing portion of FIG. 3.

As shown in FIG. 5, the first periphery plate portion 331 is apart from the second middle plate portion 361 and surrounds, but incompletely, the main body portion 365 of the second middle plate portion 361. Moreover, as shown in FIG. 6, the second periphery plate portion 371 is apart from the first middle plate portion 321 and surrounds, but incompletely, the main body portion 325 of the first middle plate portion 321. End faces of the first periphery plate portion 331 and end faces of the second middle plate portion 361 face one another in part, and end faces of the second periphery plate portion 371 and end faces of the first middle plate portion 321 face one another in part. In this way, the first principal portion 320 and the second principal portion 360 face each other to form a capacitor. However, the present invention is not limited thereto. Each of the first facing portion 32 and the second facing portion 36 may be freely modified in structure. For example, each of the first principal portion 320 and the second principal portion 360 may have a sing plate portion.

Figure 7:
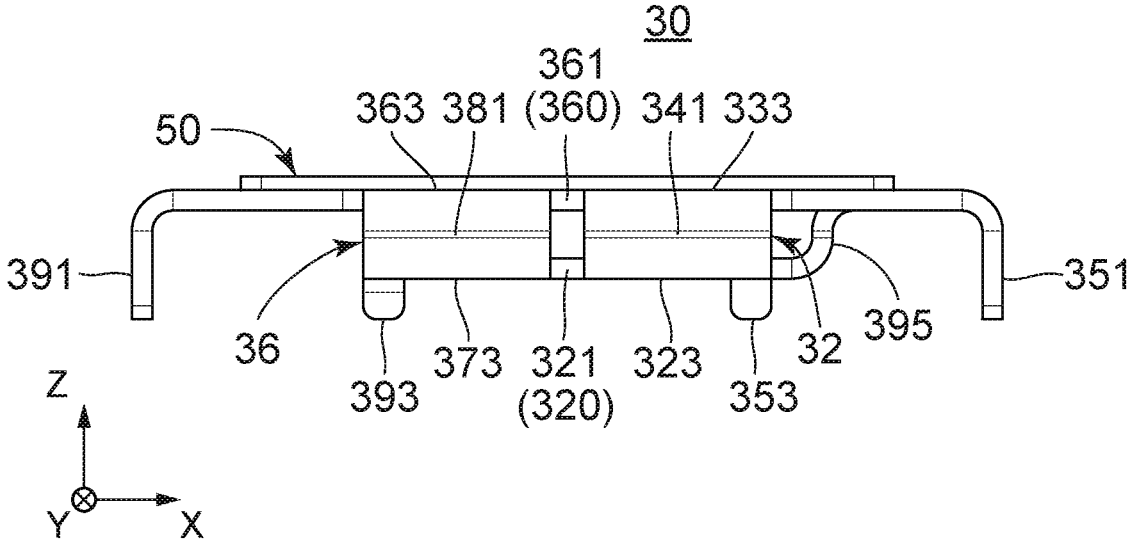
FIG. 7 is a front view showing the facing portion of FIG. 3.

As shown in FIG. 7, a lower end of the first connected portion 351, a lower end of the second connected portion 391, a lower end of the first fixed portion 353 and a lower end of the second fixed portion 393 are located at the same position as one another in the up-down direction. With this structure, mounting of the facing portion 30 to the substrate 20 can be carried out correctly. Additionally, as understood from FIG. 2, the lower end of the first connected portion 351 and the lower end of the second connected portion 391 are connected to the first end portion 227 of the antenna main portion 22 and the second end portion 229 of the antenna main portion 22, respectively. In addition, as understood from FIGS. 2 and 4, the lower end of the first fixed portion 353 and the lower end of the second fixed portion 393 are fixed to a first fixing portion 251 and a second fixing portion 253, respectively, which are formed on the upper surface of the substrate 20.

As shown in FIG. 9, the holding member 50 has a frame shape with four sides. In other words, the holding member 50 has a hollow rectangular shape or a rectangular O-shape with a through hole 52 at the center of the holding member 50 when viewed along the up-down direction. The holding member 50 has a plate shape with a relatively small size in the up-down direction. However, the present invention is not limited thereto. The holding member 50 may have another shape, such as a polygonal shape, a circular shape, an elliptical shape or the like, when viewed along the up-down direction. But, taking the size of the holding member 50 and easiness of handling the holding member 50 into consideration, it is preferable that the holding member 50 has the frame shape.

As understood from FIGS. 4 and 7, the holding member 50 is located upward of the facing portion 30 in the up-down direction. In detail, the holding member 50 holds the first held portion 355, the second held portion 395, the first fixed portion 353 and the second fixed portion 393 from above. As shown in FIGS. 5 and 6, when viewed along the up-down direction, the holding member 50 does not overlap with the first principal portion 320 and the second principal portion 360. In other words, when viewed along the perpendicular direction perpendicular to the substrate 20 or along the up-down direction, the first principal portion 320 and the second principal portion 360 are arranged in the through hole 52 of the holding member 50. According to this structure, there is an air layer having a low relative dielectric constant between the first principal portion 320 and the second principal portion 360. As a result, radiation efficiency of the antenna 10 can be improved. In particular, even when the antenna 10 is used at a high frequency, high radiation efficiency can be obtained.

As shown in FIG. 2, the upper surface of the substrate 20 is formed with the first fixing portion 251 and the second fixing portion 253 other than the first end portion 227 of the antenna main portion 22 and the second end portion 229 of the antenna main portion 22. As understood from FIGS. 2 and 4, when the facing portion 30 is mounted on the substrate 20, the first fixed portion 353 of the first facing portion 32 is mounted on the first fixing portion 251, and the second fixed portion 393 of the second facing portion 36 is mounted on the second fixing portion 253. Then, the first fixed portion 353 of the first facing portion 32 is connected to the first fixing portion 251 at the lower end of the first fixed portion 353, and the second fixed portion 393 of the second facing portion 36 is connected to the second fixing portion 253 at the lower end of the second fixed portion 393. In addition, the first connected portion 351 of the first facing portion 32 is connected to the first end portion 227 at the lower end of the first connected portion 351, and the second connected portion 391 of the second facing portion 36 is connected to the second end portion 229 at the lower end of the second connected portion 391.

According to the present embodiment, in the facing portion 30, the first facing portion 32 and the second facing portion 36 are held by the holding member 50, and thereby the relative position between the first facing portion 32 and the second facing portion 36 is fixed. Therefore, mounting of the facing portion 30 to the substrate 20 can be easily carried out, and variation of the relative position between the first facing portion 32 and the second facing portion 36 can be prevented. Thus, variation of the characteristics of the antenna 10 caused by the variation of the relative position between the first facing portion 32 and the second facing portion 36 can be prevented. Moreover, since the facing portion 30 can be easily handled, the facing portion 30 can be easily replaced, and thereby the variations of the characteristics of the antenna 10 can be easily adjusted.

Second Embodiment

Figure 10:
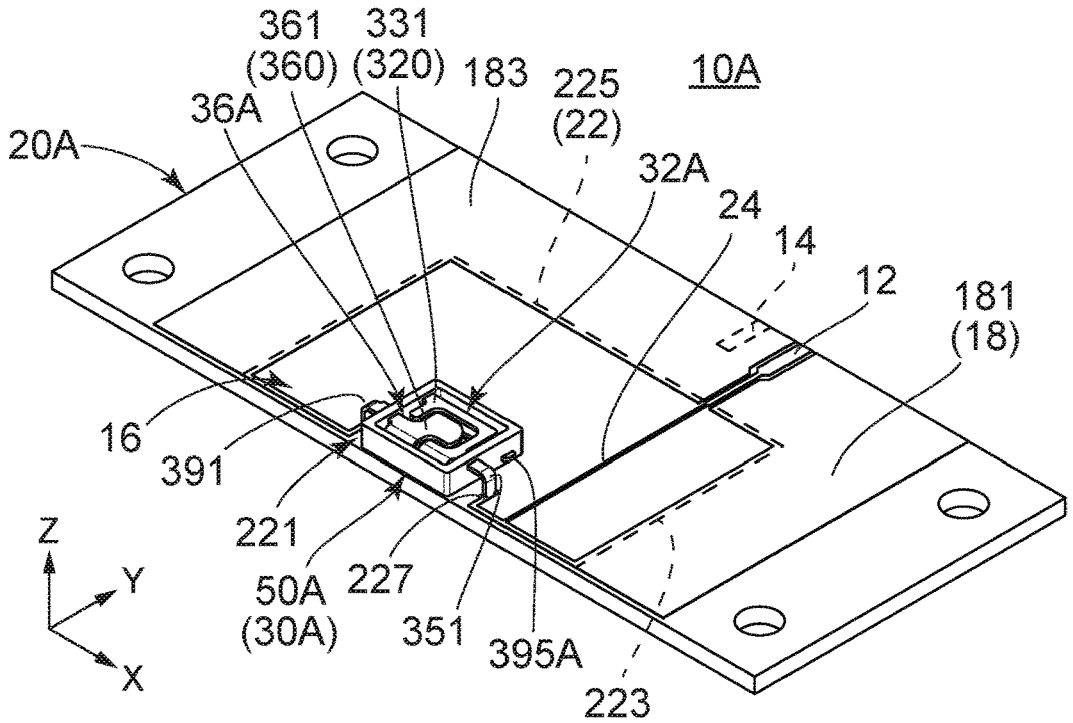
FIG. 10 is a perspective view showing an antenna according to a second embodiment of the present invention.
Figure 11:
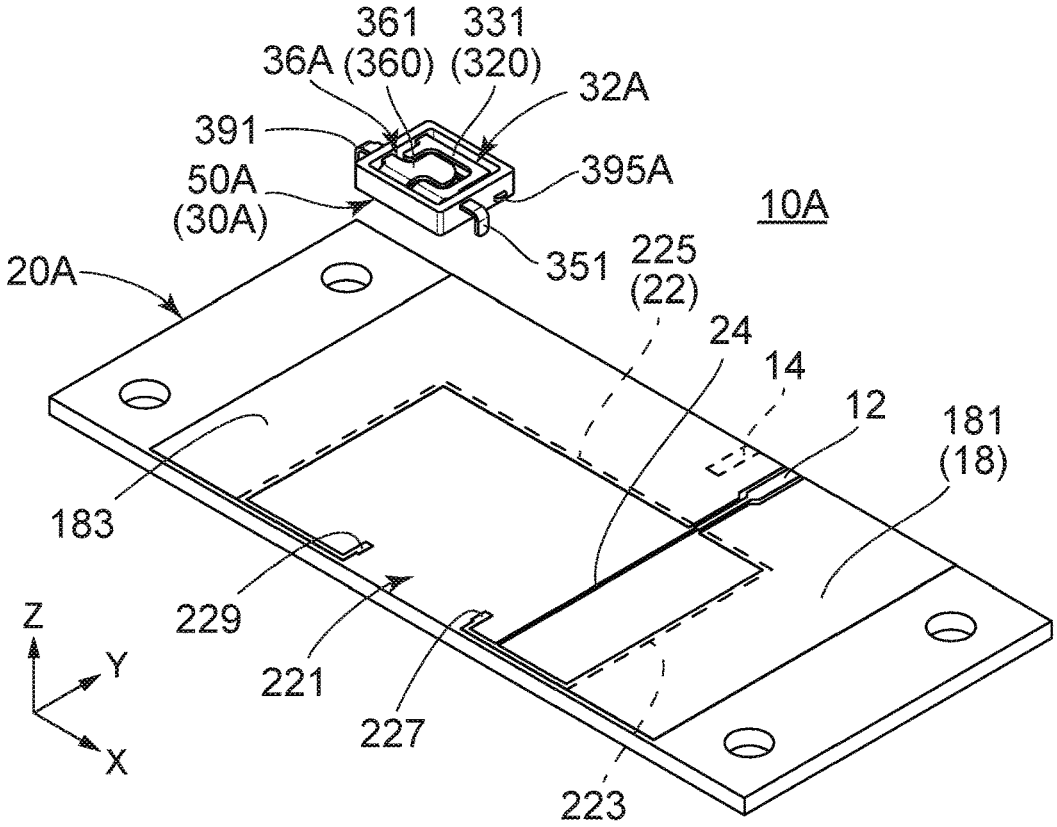
FIG. 11 is an exploded, perspective view showing the antenna of FIG. 10.

Referring to FIGS. 10 and 11, an antenna 10A according to a second embodiment of the present invention is provided with a substrate 20A and a facing portion 30A. With further reference FIG. 2, the substrate 20A is different from the substrate 20 of the first embodiment in a point that the substrate 20A does not have the first fixing portion 251 and the second fixing portion 253. Moreover, with further reference FIGS. 4 and 5, the facing portion 30A has a holding member 50A with a shape different from that of the holding member 50 of the first embodiment. In addition, as understood from FIGS. 9 and 18, a first facing portion 32A and a second facing portion 36A are different, in shape, from the first facing portion 32 and the second facing portion 36A, respectively.

Figure 18:
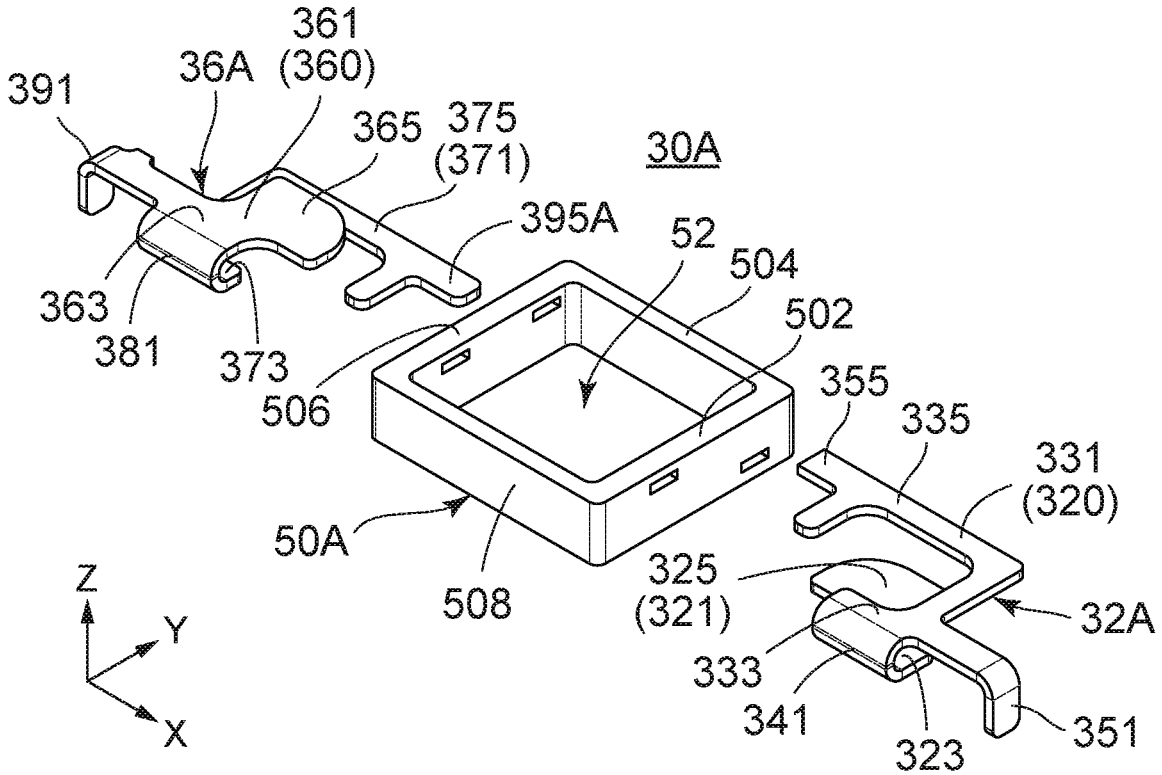
FIG. 18 is an exploded, perspective view showing the facing portion of FIG. 12.
Figure 19:
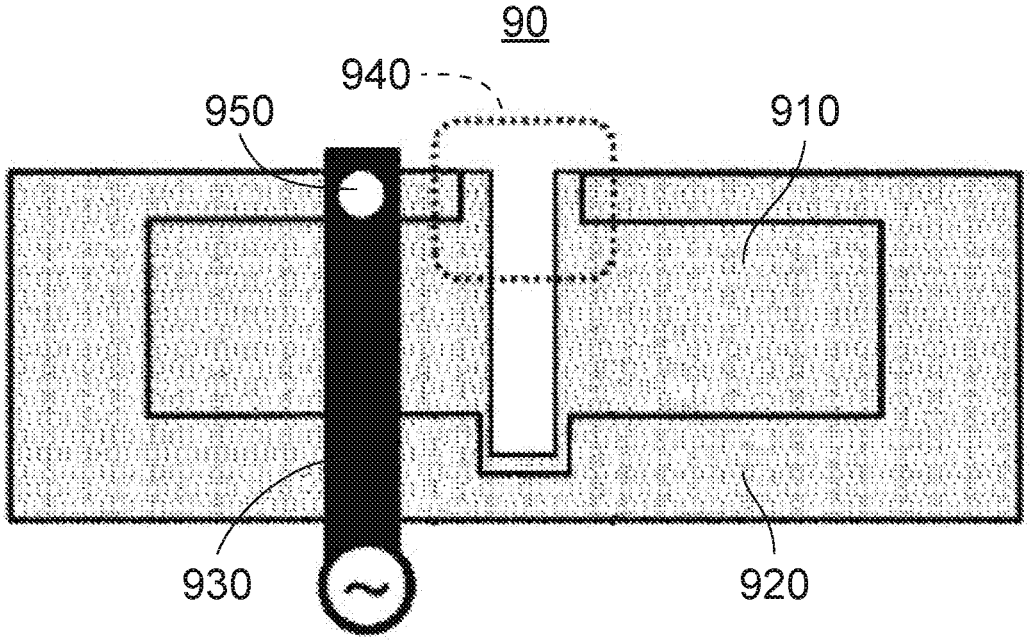
FIG. 19 PRIOR ART
FIG. 19 is a schematic structure view showing an antenna disclosed in Patent Document 1.

Referring to FIG. 18, the holding member 50A is provided with four wall portions 502, 504, 506 and 508 each of which has a predetermined size in the up-down direction. The wall portions 502, 504, 506 and 508 are joined together to form a frame shape when viewed along the up-down direction. Then, the holding member 50A has a hollow rectangular shape or a rectangular O-shape with a through hole 52 at the center of the holding member 50A when viewed along the up-down direction. A size of the holding member 50A is larger than that of the holding member 50 of the first embodiment in the up-down direction.

Figure 12:
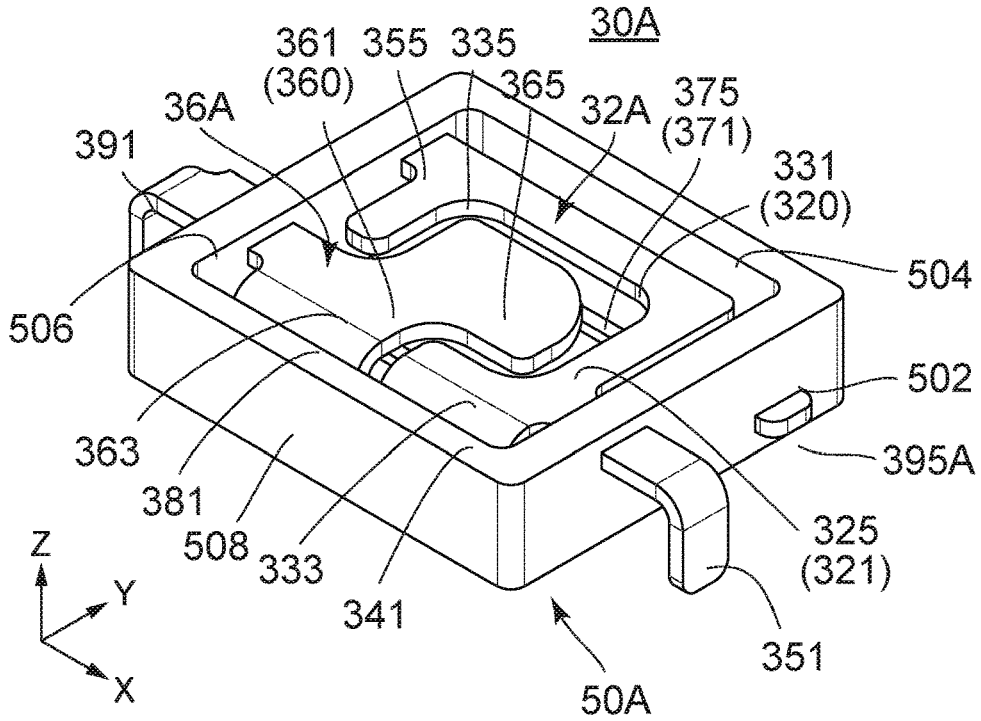
FIG. 12 is a perspective view showing a facing portion included in the antenna of FIG. 10.
Figure 13:
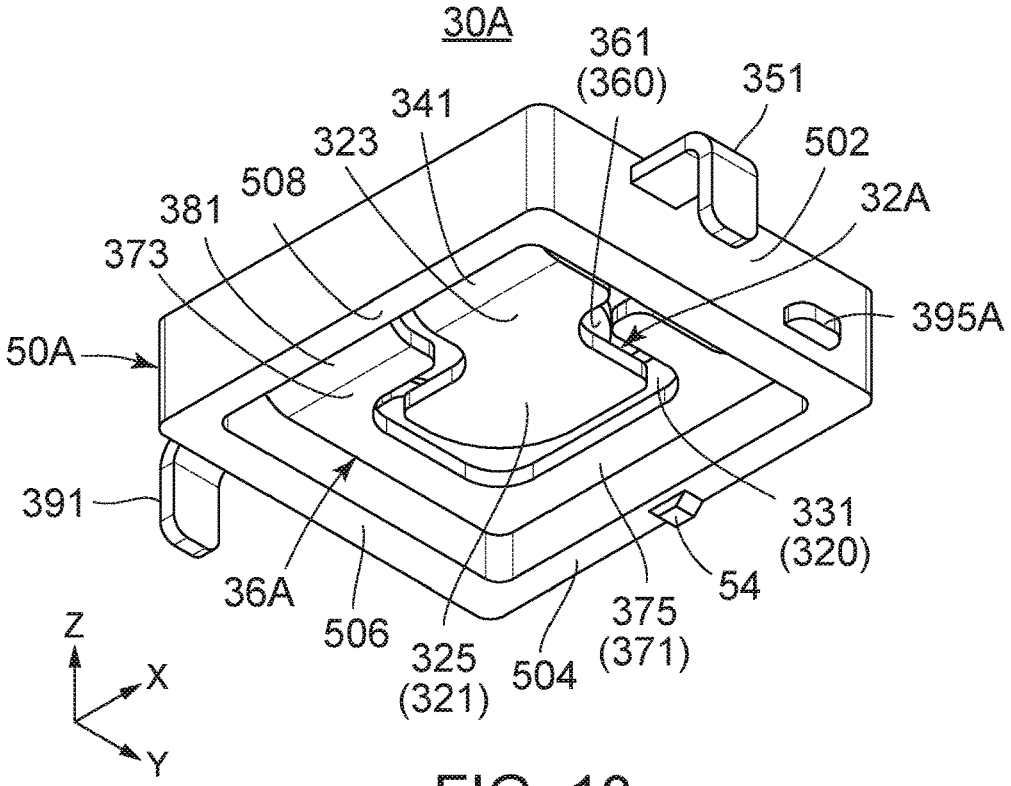
FIG. 13 is another perspective view showing the facing portion of FIG. 12.

As understood from FIGS. 12 and 13, the holding member 50A holds the first facing portion 32A and the second facing portion 36A in a state that the first facing portion 32A and the second facing portion 36A are apart from each other. In the present embodiment, the holding member 50A is formed integrally with the first facing portion 32A and the second facing portion 36A.

Figure 14:
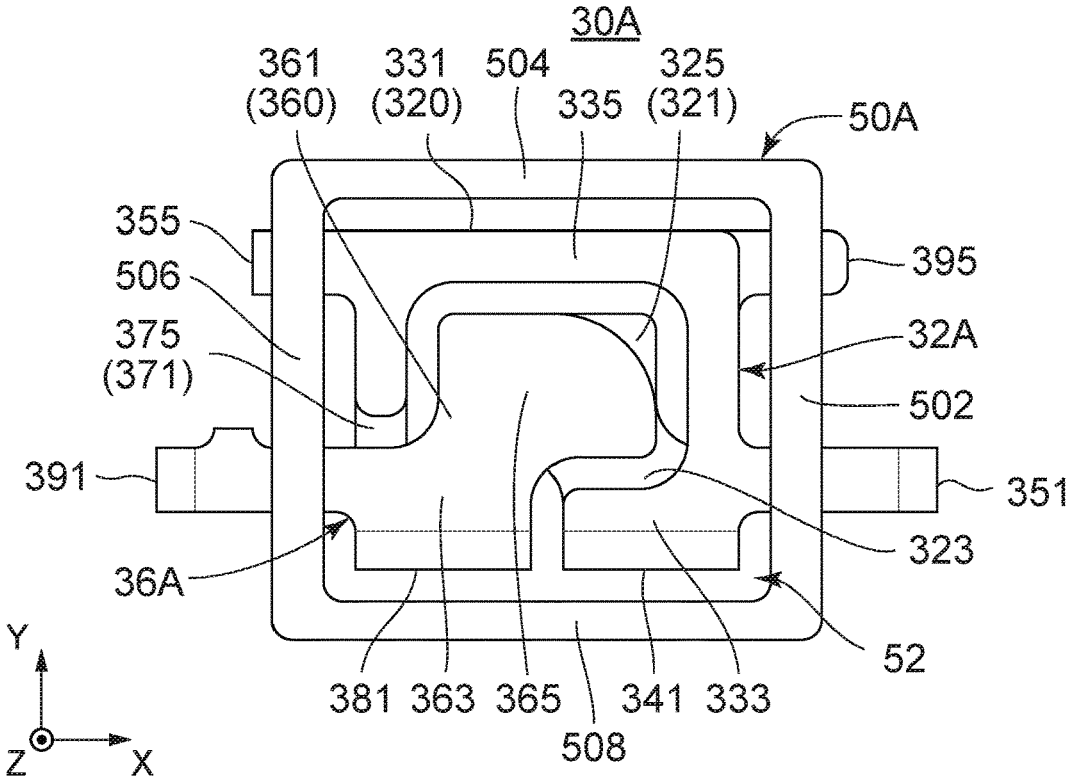
FIG. 14 is a plan view showing the facing portion of FIG. 12.
Figure 15:
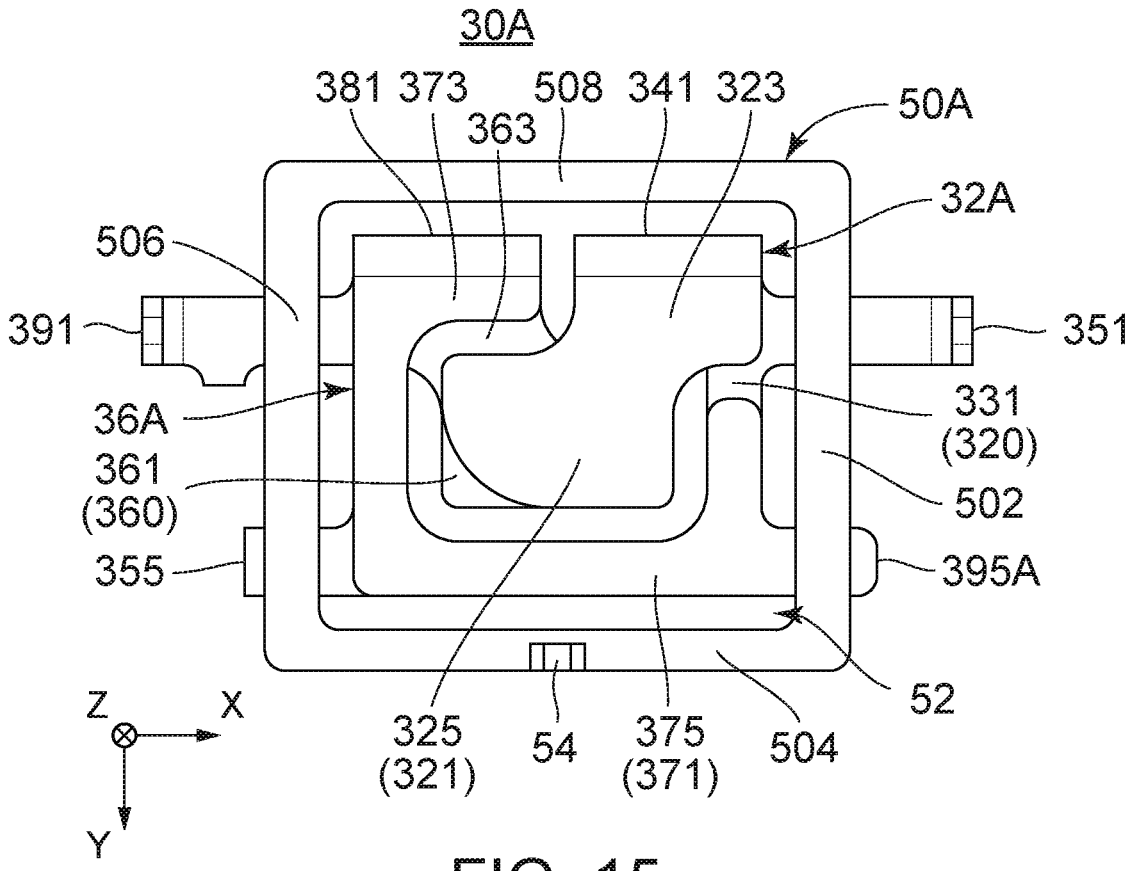
FIG. 15 is a bottom view showing the facing portion of FIG. 12.
Figure 16:
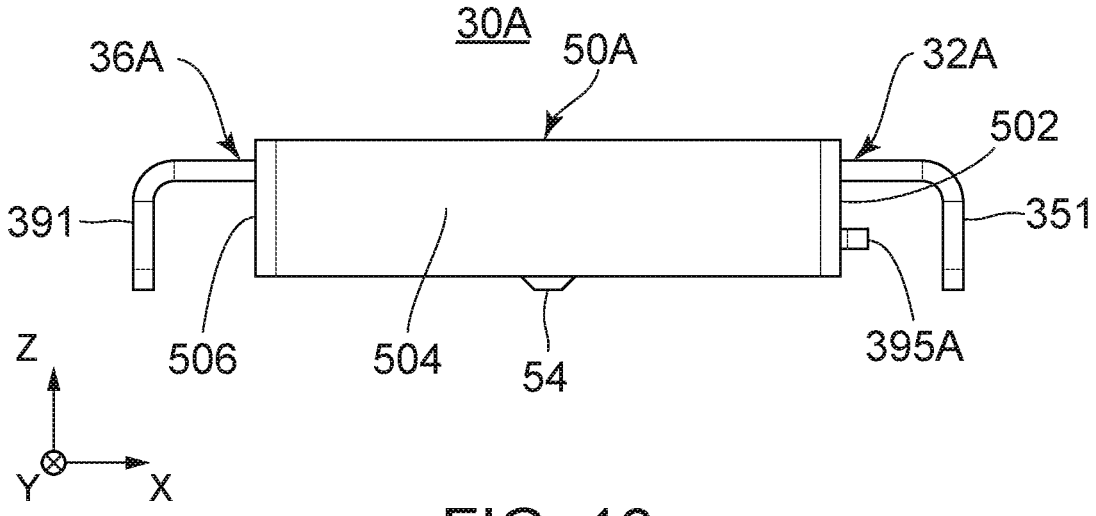
FIG. 16 is a front view showing the facing portion of FIG. 12.
Figure 17:
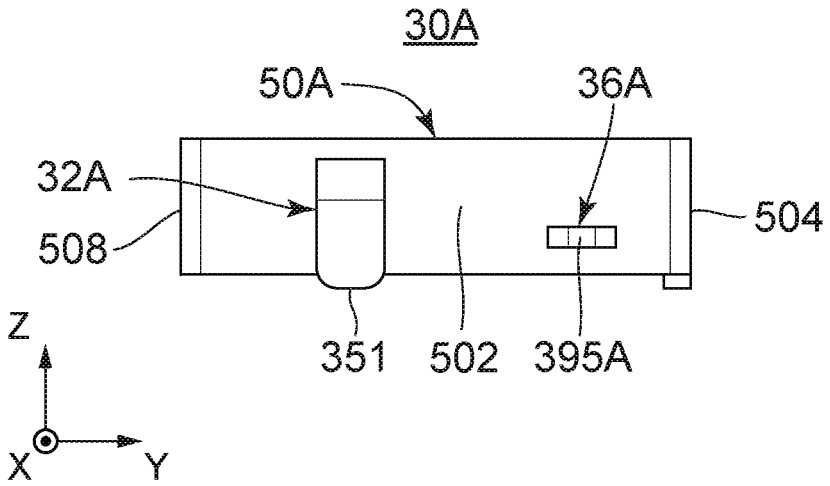
FIG. 17 is a right side view showing the facing portion of FIG. 12.

As understood from FIGS. 12 to 15, the holding member 50A surrounds the first principal portion 320 of the first facing portion 32A and the second principal portion 360 of the second facing portion 36A in a plane perpendicular to the up-down direction. As shown in FIGS. 16 and 17, the first principal portion 320 and the second principal portion 360 are not visible in each of the front-rear direction and the lateral direction. On the other hand, as shown in FIGS. 14 and 15, when viewed along the up-down direction, the holding member 50A does not overlap with the first principal portion 320 and the second principal portion 360. In other words, when viewed along the perpendicular direction perpendicular to the substrate 20A, the first principal portion 320 and the second principal portion 360 are arranged in the through hole 52 of the holding member 50A.

As understood from FIGS. 15 to 18, a first connected portion 351 of the first facing portion 32A and a second held portion 395A of the second facing portion 36A pierce the wall portion 502 in the lateral direction. Moreover, a first held portion 355 of the first facing portion 32A and a second connected portion 391 of the second facing portion 36A pierce the wall portion 506 in the lateral direction. An end portion of the first held portion 355 of the first facing portion 32A and an end portion of the second held portion 395A of the second facing portion 36A are directed outward in the lateral direction. With this structure, the holding member 50A can hold firmly the first facing portion 32A and the second facing portion 36A in comparison with the holding member 50 of the first embodiment. In addition, similarly to the antenna 10 of the first embodiment, the antenna 10A can obtain high radiation efficiency.

As understood from FIGS. 16 and 17, a lower end of the first connected portion 351 of the first facing portion 32A and a lower end of the second connected portion 391 of the second facing portion 36A are located downward of lower edges of the wall portions 502, 504, 506 and 508. On the other hand, the lower edge of the wall portion 504 is formed with a mounted portion 54. As understood from comparison between FIG. 4 and FIG. 13, the mounted portion 54 is mounted on an upper surface of the substrate 20A as a substitute for the first fixed portion 353 of the first embodiment or the second fixed portion 393 of the first embodiment. As shown in FIGS. 16 and 17, a lower end of the mounted portion 54 is identical in position with the lower end of the first connected portion 351 of the first facing portion 32A and the lower end of the second connected portion 391 of the second facing portion 36A in the up-down direction. Accordingly, when the facing portion 30A is mounted on the substrate 20A, a space can be formed between the lower edges of the wall portions 502, 504, 506 and 508 and the upper surface of the substrate 20A, and the facing portion 30A can be stably fixed to the substrate 20A. According to this structure, the first fixed portion 353 (see FIG. 4) of the first embodiment and the second fixed portion 393 (see FIG. 4) of the first embodiment are unnecessary. Therefore, the first facing portion 32A and the second facing portion 36A can be simplified in structure in comparison with the first facing portion 32 of the first embodiment and the second facing portion 36 of the first embodiment. However, the present invention is not limited thereto. Similarly to the first embodiment, the first facing portion 32A and the second facing portion 36A may have the first fixed portion 353 and the second fixed portion 393, respectively.

Also in the facing portion 30A according to the present embodiment, similarly to the facing portion 30 of the first embodiment, the first facing portion 32A and the second facing portion 36A are held by the holding member 50A, and thereby the relative position between the first facing portion 32A and the second facing portion 36A is fixed. Accordingly, the present embodiment can obtain effects similar to those of the first embodiment.

Although the specific explanation about the present invention is made above referring to the embodiments, the present invention is not limited thereto but susceptible of various modifications and alternative forms without departing from the spirit of the invention. For example, as the substrate 20 or 20A, a double-sided substrate or a multilayer substrate may be used. Moreover, each of the first facing portion 32 or 32A and the second facing portion 36 or 36A may have a shape different from the shapes in the aforementioned embodiments. As an example, the first facing portion 32 or 32A and the second facing portion 36 or 36A may be formed as comb shapes and arranged to form an interdigital structure.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An antenna comprising:

an antenna main portion formed on a substrate; and a facing portion separate and distinct from the substrate, wherein:

the antenna main portion has a ring shape with a split and has a first end portion and a second end portion which are located apart from each other in a lateral direction parallel with the substrate to form the split;

the facing portion has a holding member, a first facing portion made of conductive material, and a second facing portion made of the conductive material;

the first facing portion and the second facing portion are held by the holding member so as to be located apart from each other;

the first facing portion has a first principal portion and a first connected portion which extends from the first principal portion and which is connected to the first end portion; and the second facing portion has a second principal portion facing the first principal portion and a second connected portion which extends from the second principal portion and which is connected to the second end portion.

2. The antenna as recited in claim 1, wherein when viewed along a perpendicular direction perpendicular to the substrate, the first principal portion and the second principal portion do not overlap with the holding member.

3. The antenna as recited in claim 2, wherein:

when viewed along the perpendicular direction, the holding member has a hollow rectangular shape with a through hole at a center of the holding member; and when viewed along the perpendicular direction, the first principal portion of the facing portion and the second principal portion of the facing portion are arranged in the through hole.

4. The antenna as recited in claim 1, wherein the holding member is provided with a mounting portion mountable on the substrate.

5. The antenna as recited in claim 1, wherein each of the first facing portion and the second facing portion is provided with a mounting portion mountable on the substrate.

* * * * *